United States Patent [19]

Springston et al.

[11] Patent Number: 4,605,337

[45] Date of Patent: Aug. 12, 1986

[54] EXPEDIENT RUNWAY SURFACING WITH POST TENSIONING SYSTEM FOR EXPEDITIONARY AIRFIELDS

[75] Inventors: Preston S. Springston, Oxnard, Calif.; Richard L. Claxton, Evanston, Ill.

[73] Assignee: The United States of America as represented by the Secretary of the Navy, Washington, D.C.

[21] Appl. No.: 702,091

[22] Filed: Feb. 11, 1985

[51] Int. Cl.[4] ..... E01C 9/08

[52] U.S. Cl. ..... 404/35; 404/40; 404/45; 404/73

[58] Field of Search ..... 404/34, 18, 29, 35, 404/45, 47, 70, 7, 36, 40, 73; 14/1, 2.4, 73; 52/227, 230, 747, 166; 264/33, 34, 228, 229; 249/2, 189, 208

[56] References Cited

U.S. PATENT DOCUMENTS

| | | | |
|---|---|---|---|
| 3,089,215 | 5/1963 | Stubbs | 404/70 X |
| 3,094,907 | 6/1963 | Hirst | 404/40 |
| 3,399,434 | 9/1968 | Kelly | 52/230 X |
| 4,404,244 | 9/1983 | Springston | 404/72 X |

FOREIGN PATENT DOCUMENTS

| | | | |
|---|---|---|---|
| 1534246 | 12/1969 | Fed. Rep. of Germany | 404/41 |

*Primary Examiner*—Stephen J. Novosad
*Assistant Examiner*—Matthew Smith
*Attorney, Agent, or Firm*—Robert F. Beers; Joseph M. St.Amand

[57] ABSTRACT

A portable airfield runway having an anchoring and tensioning system is comprised of a plurality of fiberglass reinforced plastic panels anchored with earth anchors at each end of the runway and uses self-contained hydraulic tensioning and load maintenance units to maintain constant tension on the runway while allowing for both expansion/contraction due to temperature and dynamic aircraft braking loads.

6 Claims, 6 Drawing Figures

EXPEDIENT RUNWAY SURFACING WITH POST TENSIONING SYSTEM FOR EXPEDITIONARY AIRFIELDS

This invention relates to co-pending U.S. patent application Ser. No. 631,954 filed July 17, 1984 by Preston S. Springston and Richard L. Claxton for PREFABRICATED PANELS FOR RAPID RUNWAY REPAIR AND EXPEDIENT AIRFIELD SURFACING, and commonly assigned.

BACKGROUND OF THE INVENTION

This invention relates to runway surfacing, and particularly to a runway formed from a plurality of interconnected portable fiberglass reinforced polyester mat panels in conjunction with earth anchors and hydraulic tensioning system.

Currently there are a variety of portable airfield landing mats in the prior art literature. However, most such mats are for lightweight aircraft, helicopters and VTO aircraft, and are unsuitable for heavy aircraft. One matting presently in use for surfacing of expeditionary airfields and for rapid runway repair consists of extruded aluminum planks. The aluminum matting planks, however, are difficult to produce and are expensive, and also present a bump profile which causes overstressing of critical components of aircraft which must traverse bomb craters in runways surfaced over with such matting. Other landing mats involve complex laminar and/or mechanical structures which are also difficult and expensive to produce, and do not provide anchoring with a constant tension on the runway while allowing for expansion/contraction.

SUMMARY OF THE INVENTION

The present invention is a portable airfield landing mat and anchoring and tension system for commercial and military use in the expedient surfacing of forward area airfields. The invention comprises a panel which can be linked with others to form airfield runways and also to form a protective and trafficable cover over backfilled bomb craters in conventional airfield pavements. The invention has further utility as a relocatable surfacing for runways and parking aprons of V/STOL forward operating facilities and taxiways and parking aprons of expeditionary air bases and expeditionary airfields.

The portable panels each consist of a fiberglass reinforced plastic composite mat. The panels are connected together with bolts to form airfield surfacing and pavement repair. A self-contained, closed hydraulic tension and load maintenance device which maintains a nearly constant tension on the runway while allowing for expansion/contraction along with deadman type earth anchors provide the necessary reaction force at each runway end.

DESCRIPTION OF THE PREFERRED EMBODIMENT

Figure 1:
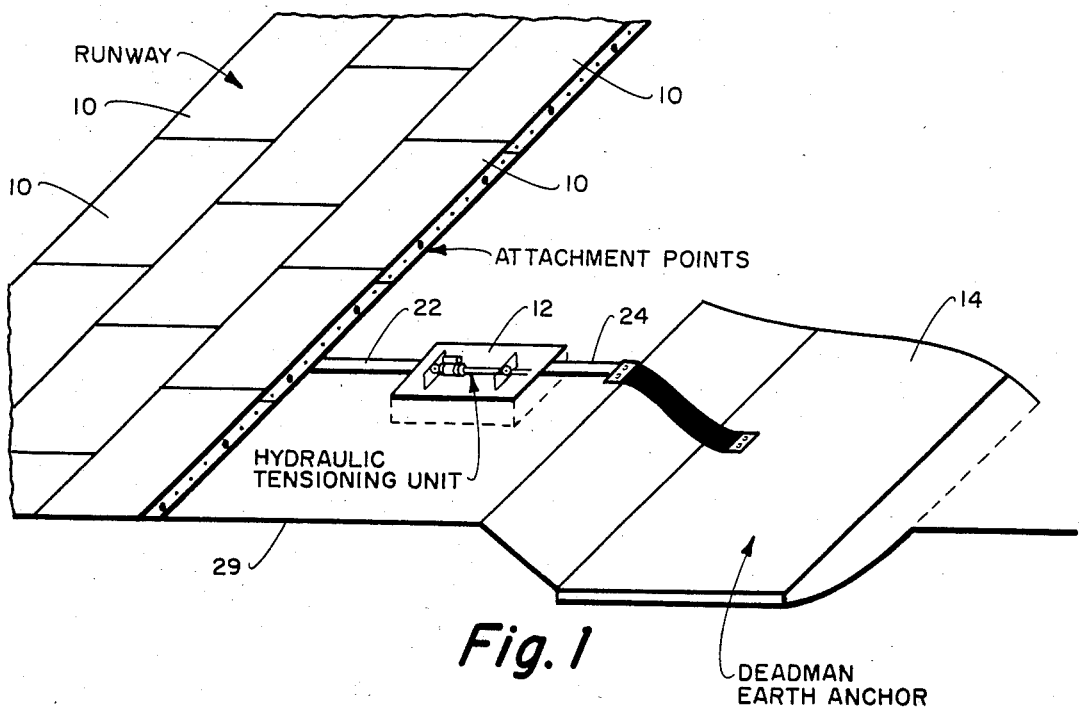
FIG. 1 illustrates a preferred embodiment of the present invention showing a runway system formed from a plurality of panels shown in FIG. 2 with a post tensioning unit and earth anchor.
Figure 2:
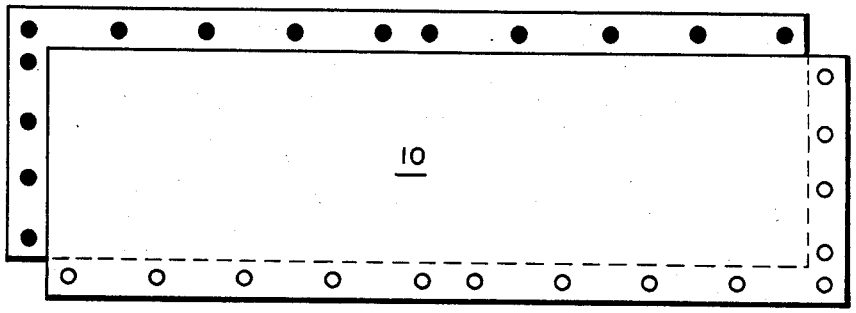
FIG. 2 is a plan view of a prefabricated fiberglass reinforced plastic panel used to form an airfield runway.

The expedient airfield runway of this invention has three primary components: fiberglass reinforced polyester panels 10, hydraulic tensioning units 12, and earth anchors 14, as shown in FIG. 1. A typical fiberglass reinforced panel (i.e., plastic composite matting panel) is shown in FIG. 2 and is further reinforced along its edges with cloth or woven aramid fibers. Runway panel composition fabrication and assembly are fully disclosed and discussed in aforementioned U.S. patent application Ser. No. 631,954. The fiberglass matting panels 10 are readily field assembled to form a runway taxiway or parking apron. The hydraulic tensioning units 12 are connected along panel edges at one or opposite ends of the assembled runway, and are used in conjunction with earth anchors, as shown in FIG. 1, for post tensioning of a fiberglass reinforced panel surfaced runway.

Figure 3:
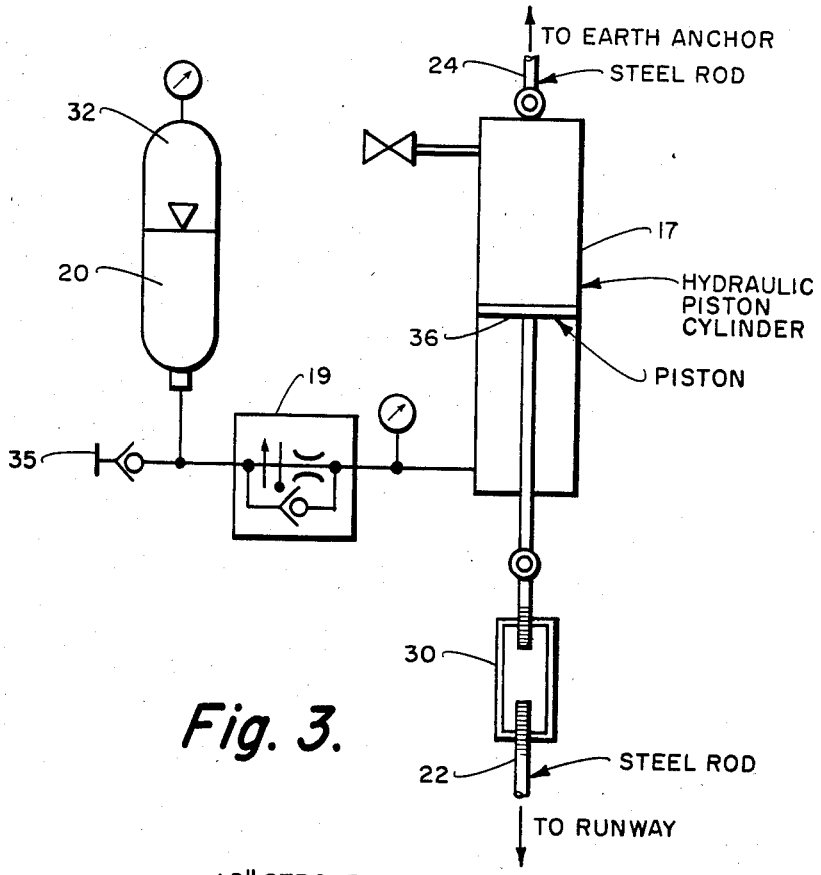
FIG. 3 is a schematic diagram of a tensioning unit shown in FIG. 2 for runway tensioning/load maintenance.

A single tensioning unit 12 is shown in the schematic of FIG. 3 and is composed of a dual acting hydraulic cylinder 17 (having a 12 inch stroke, for example), a flow control valve with integral check valve 19, and a bladder type accumulator 20. One end of the tensioning unit 12 is connected to an edge of the runway mat via a steel rod 22 and the other end connected to an earth anchor via steel rod 24. A deadman earth anchor 14 is shown in FIG. 1, however, other suitable earth anchors can be used, and two alternate earth anchors are shown in FIGS. 4*a* and 4*b*, by way of example.

Figure 4A:
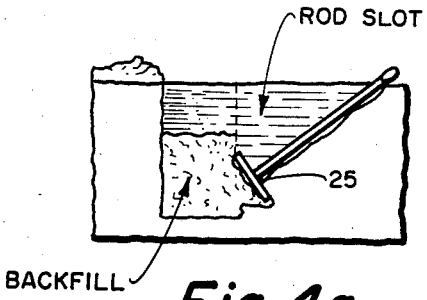
FIG. 4*a* shows a side view of a cross plate ground anchor.
Figure 4B:
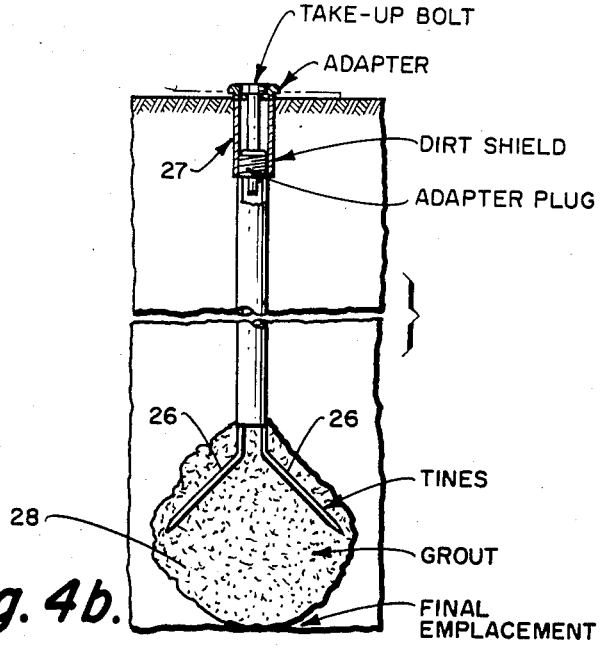
FIG. 4*b* is a side, partially cross-sectional view of an alternate earth anchor.

FIG. 4*a* illustrates a cross plate earth anchor 25 positioned in a slot in the ground which is then backfilled. Steel rod 24 from a tensioning unit 12 connects to the rod of anchor 25. The earth anchor of FIG. 4*b* uses a tubular shaft with tines 26 having an adapter plug 27 and take-up bolt assembly which is used to fasten a connection means to steel rod 24 of the tensioning unit. Tines 26 of the tubular shaft are secured in the ground with a grout 28. Other suitable earth anchors can also be used with the present system.

This invention may be used in conjunction with soil stabilization either by conventional chemical stabilizers, e.g., lime, cement, asphalt, or by mechanical means such as soil grid reinforcement or a lower membrane placed in the subgrade for soil reinforcement. With soil stabilization/reinforcement the invention can be used for surfacing of runways for use by medium weight and cargo aircraft.

The airfield surface of the present invention is installed as follows: the runway ground surface 29 is compacted and graded. Then the fiberglass reinforced panels 10 are assembled on the runway ground surface 29 and bolted together. A number of earth anchors 14 are installed at suitable intervals along each end of the runway (a typical 72×900 ft STOL runway requires eight evenly spaced earth anchors and hydraulic units at each runway end). Boxes containing the hydraulic tensioning units 12 are set just below the grade of runway ground surface 29 between respective ground anchors and the runway end (see FIG. 1). Steel rods 22 having threaded ends and a turnbuckle 30 are connected to the edge of matting 10 by suitable means such as shackles, bolts, etc. (not shown). The opposite end of the tensioning units are connected to the earth anchors 14.

Figure 5:
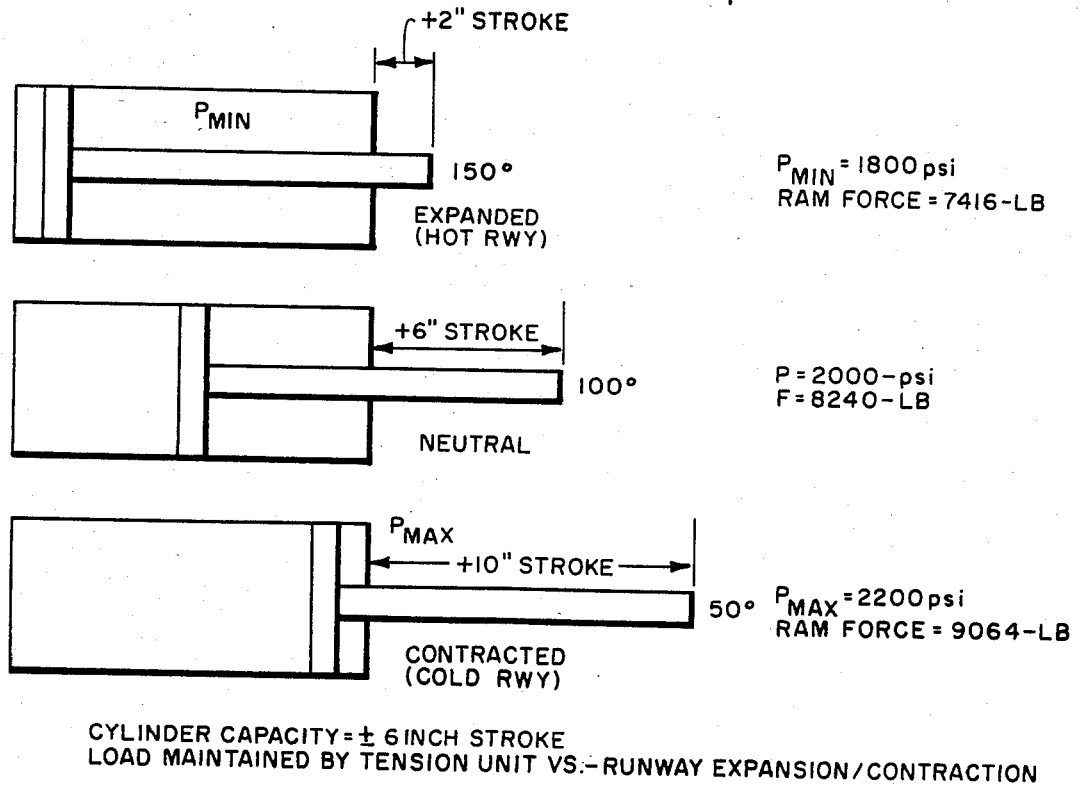
FIG. 5 illustrates load maintained by a tension unit versus runway expansion/contraction.

The runway is then tensioned by adjusting each hydraulic tension unit as follows. Accumulator 20 is precharged with 1600 psi of nitrogen 32, for example; a bladder within the accumulator separates nitrogen 32 from hydraulic fluid. Hydraulic fluid is pumped into the system at quick disconnect coupling 35 to an hydraulic fluid pressure of 1600 psi, for example. Slack is removed from the steel tensioning rods 22 and 24 and the hydraulic piston 36 is positioned properly by means of turnbuckle 30. Depending upon the time of day (i.e., runway expansion condition) the system is pumped with hydraulic fluid to one of the pressures indicated in FIG. 5 which shows piston position at 150 degrees F., 100 degrees F., and 50 degrees F. for a 12 inch hydraulic cylinder. Each tensioning unit 12 is adjusted per the foregoing procedure starting with those units at the runway centerline and proceeding outward in a symmetrical fashion to those at the runway edge. Each end of the runway is tensioned concurrently. The system is now ready for operation.

Once in operation the system performs as follows: The fiberglass reinforced panels 10 matting distributes aircraft wheel loads to the underlying subgrade thereby affording long traffic life. The tension units 12 system maintains tension on the runway within prescribed bounds. For a 72×900 ft STOL runway each end has an applied tension of between 56,000 and 72,000 lb, for example, depending upon ambient conditions. This tension prevents warping of the runway as a result of expansion/contraction and prevents the development of a matting bow wave ahead of the landing gear of braking aircraft.

A tension unit 12 operates as follows: Runway expansion causes the cylinder piston 36, FIG. 3, to retract thereby increasing cylinder 17 volume. System pressure is maintained by accumulator 20 which forces additional pressurized hydraulic fluid into the system accompanied by a slight drop in gas pressure and fluid pressure, and, consequently, runway tension. Runway contraction causes piston 36 to be withdrawn from cylinder 17 thereby reducing cylinder 17 volume. Hydraulic fluid is forced into accumulator 20 compressing the nitrogen gas 32 thereby resulting in a slight rise in system pressure, and, consequently, runway tension. A flow control valve with integral check valve 19 permits unrestricted relatively slow (quasi static) flow of fluid resulting from runway expansion/contraction. An aircraft braking on the runway, however, will produce a very short term dynamic effect. The flow control valve 19 will allow only minimal by-pass of fluid under such a dynamic shock loading condition. The fluid being noncompressible, the aircraft braking forces in the matting will be transmitted directly from the matting 10, through the tension unit 12, and to the anchor system 14.

Obviously many modifications and variations of the present invention are possible in light of the above teachings. It is therefore to be understood that within the scope of the appended claims the invention may be practiced otherwise than as specifically described.

What is claimed is:

1. An expedient airfield runway surfacing system having an anchoring and tensioning system for maintaining constant tension on the runway while allowing for both expansion/contraction due to temperature and dynamic aircraft braking loads, comprising:

a. A plurality of prefabricated portable panels interconnected together to form airfield surfacing matting over a prepared ground subsurface and operating to distrubute aircraft wheel loads to the underlying subsurface;

b. a plurality of hydraulic automatic tensioning means and earth anchoring means positioned at at least one end of the airfield along the perimeter of the airfield surfacing matting formed from said the plurality of prefabricated portable panels;

c. said tensioning means each having one side thereof connected to an edge of said airfield surfacing matting and the opposite side thereof connected to an earth anchoring means and being adjustable to airfield runway expansion/contraction conditions as determined by the ambient temperatures of said airfield surfacing matting;

d. each said tensioning means being operable to maintain prescribed reaction forces to provide automatic constant and and uniform tension on said airfield surfacing matting during dynamic shock loading due to aircraft landing and braking while simultaneously compensating for expansion/contraction of said airfield surfacing matting due to ambient temperature changes; wherein development of a matting bow wave ahead of the landing gear of braking aircraft is avoided and warping of the runway surfacing as a result of expansion/contraction is prevented.

2. An expedient airfield surfacing system as in claim 1 wherein said prefabricated panels are fiberglass reinforced plastic.

3. An expedient airfield surfacing system as in claim 1 wherein said prefabricated panels are fiberglass reinforced polyester.

4. An expedient airfield surfacing system as in claim 1 wherein the earth anchoring means for securing said tensioning means in position are deadman type earth anchors.

5. An expedient airfield surfacing system as in claim 1 wherein said automatic tensioning means is an adjustable hydraulic system for maintaining constant tension on said airfield surfacing matting.

6. An expedient airfield surfacing system as in claim 5 wherein said hydraulic automatic tensioning means includes: a dual acting hydraulic cylinder and piston assembly; a gas bladder type hydraulic accumulator; and an hydraulic flow control valve with integral check valve; said hydraulic automatic tensioning means operating as follows: expansion of said airfield surfacing matting cuasing said dual acting hydraulic cylinder piston to retract thereby increasing the cylinder volume; the adjustable hydraulic system pressure being maintained by said gas bladder type hydraulic accumulator which forces additional pressurized hydraulic fluid into the hydraulic system accompanied by a slight drop in gas pressure and fluid pressure, and, consequently, in airfield surfacing matting tension; contraction of said airfield surfacing matting causing the hydraulic piston to be withdrawn from said dual acting hydraulic cylinder thereby reducing the cylinder volume and forcing hydraulic fluid into said hydraulic accumulator compressing the gas and thereby resulting in a slight rise in hydraulic system pressure, and, consequently, in airfield surfacing matting tension; said flow control valve with integral check valve permitting unrestricted relatively slow (quasi static) flow of hydraulic fluid resulting from airfield surfacing matting expansion/contraction; said flow control valve allowing only minimal by-pass of hydraulic fluid under dynamic shock loading condition resulting in aircraft braking forces applied to said surfacing matting being ransmitted directly from the surfacing matting through the automatic tensioning means to the earth anchoring means.

* * * * *